US005255390A

United States Patent [19]

Gross et al.

[11] Patent Number: 5,255,390

[45] Date of Patent: Oct. 26, 1993

[54] GAS VENTILATED GARMENT HAVING A LOW GAS CONSUMPTION VALVING CONFIGURATION

[75] Inventors: Stanford A. Gross, Elkin Park, Pa.; Stanley Bauman, Dover, Del.

[73] Assignee: Chem-Tex Corporation, Trenton, N.J.

[21] Appl. No.: 984,754

[22] Filed: Dec. 3, 1992

[51] Int. Cl.[5] ..... A62B 17/00

[52] U.S. Cl. ..... 2/2; 2/69; 2/DIG. 1; 2/DIG. 3; 607/104; 607/108; 607/109

[58] Field of Search ..... 2/2.1 A, 2.1 R, 69, 2/DIG. 1, DIG. 3; 251/205, 273, 318, 274, 264; 128/399, 400

[56] References Cited

U.S. PATENT DOCUMENTS

| | | | |
|---|---|---|---|
| 2,712,399 | 7/1955 | Blears . | |
| 2,826,758 | 3/1958 | Kahn | 2/DIG. 1 |
| 3,083,554 | 4/1963 | Iketani . | |
| 3,113,320 | 12/1963 | Cherowbrier et al. . | |
| 3,161,033 | 12/1964 | Iketani . | |
| 3,174,300 | 3/1965 | Webb . | |
| 3,289,748 | 12/1966 | Jennings . | |
| 3,345,641 | 10/1967 | Jennings . | |
| 3,348,236 | 10/1967 | Copeland . | |
| 3,496,703 | 2/1970 | MacLeod et al. . | |
| 3,568,209 | 3/1971 | O'Neill et al. . | |
| 3,675,244 | 7/1972 | Mayo et al. . | |
| 3,710,395 | 1/1973 | Spano et al. . | |
| 3,761,962 | 10/1973 | Myers . | |
| 3,777,750 | 12/1973 | Savornin . | |
| 3,790,964 | 2/1974 | Hartigan . | |
| 3,829,124 | 8/1974 | Charns et al. . | |
| 3,942,684 | 3/1976 | Stetson . | |
| 3,986,456 | 10/1976 | Doin et al. . | |
| 4,146,933 | 4/1979 | Jenkins et al. | 2/DIG. 1 |
| 4,185,327 | 1/1980 | Markve . | |
| 4,194,247 | 3/1980 | Melander . | |
| 4,246,672 | 1/1981 | Fujiyama et al. . | |
| 4,403,608 | 9/1983 | Warncke . | |
| 4,513,452 | 4/1985 | Rankin et al. . | |
| 4,619,285 | 10/1986 | Piet . | |
| 4,911,403 | 3/1990 | Lockwood, Jr. . | |
| 4,914,752 | 4/1990 | Hinson et al. . | |
| 4,929,176 | 5/1990 | Nitta . | |
| 5,005,216 | 4/1991 | Blackburn et al. . | |
| 5,070,858 | 12/1991 | Wang . | |
| 5,088,115 | 2/1992 | Napolitano | 2/2.1 A |

*Primary Examiner*—Clifford D. Crowder
*Assistant Examiner*—Gloria Hale
*Attorney, Agent, or Firm*—Sperry, Zoda & Kane

[57] ABSTRACT

A gas ventilated garment including a primary manifold for receiving air at 20 to 125 pounds per square inch which is connected through a plurality of gas conduits to a plurality of radial dispersion valves positioned at various locations throughout a garment such as a jacket to slowly release air adjacent the body of a user for cooling. The individual radial valves are adapted to release the pressurized gas at extremely low rates normally being less than one cubic feet per minute. The configuration of the radial valves is unique in the restriction to a very low volume rate of release as well as a unique radial configuration allowing the gas to be dispersed in a radial or circular fashion from the individual locations thereby achieving cooling with a skew as seven or less individual ventilation gas radial dispersion valves strategically positioned throughout a garment such as a jacket.

26 Claims, 3 Drawing Sheets

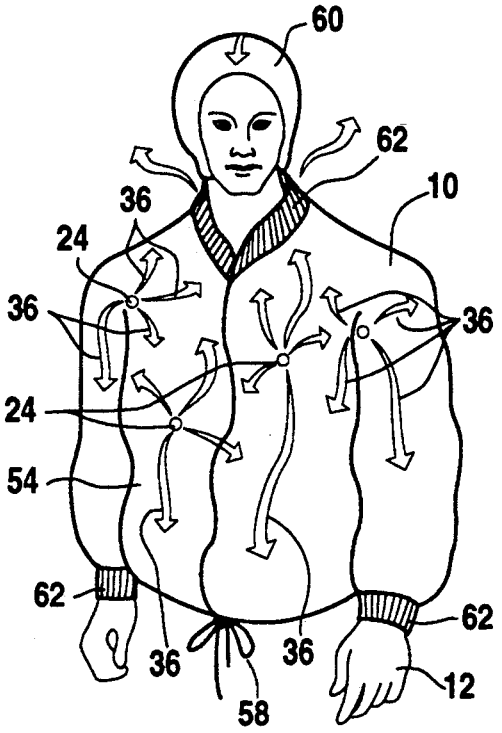
Fig. 1
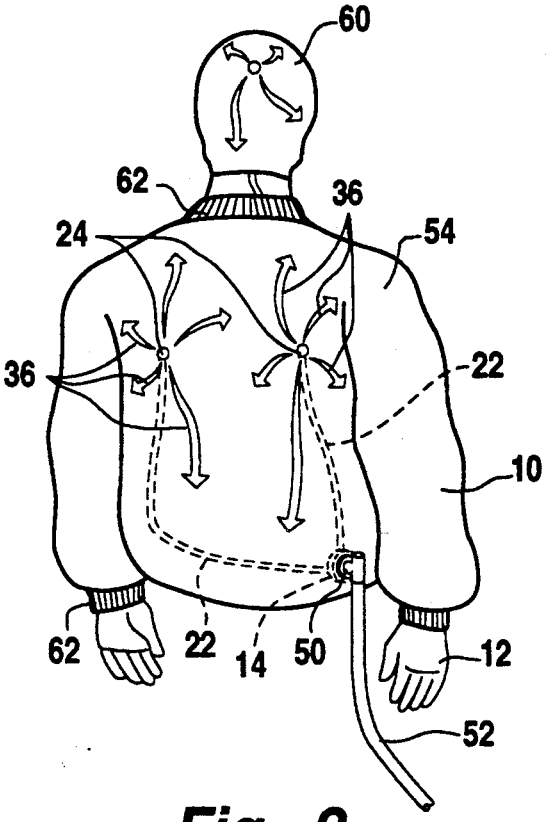
Fig. 2
Fig. 3
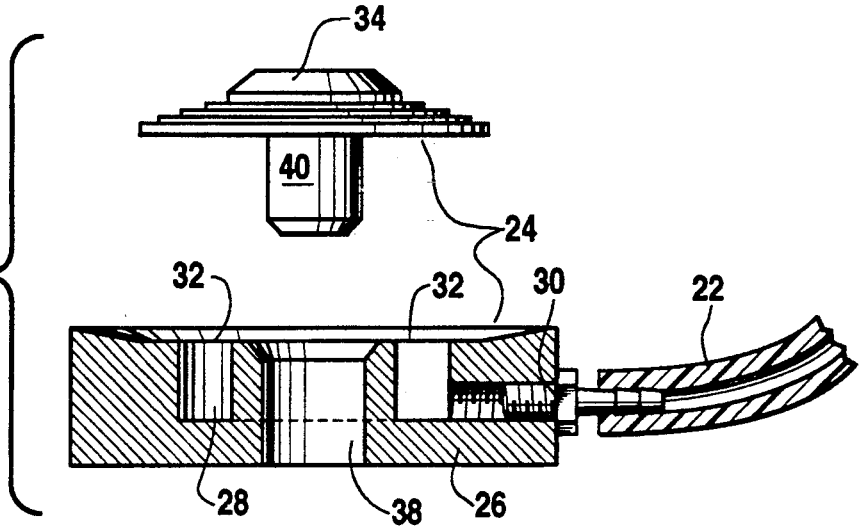

GAS VENTILATED GARMENT HAVING A LOW GAS CONSUMPTION VALVING CONFIGURATION

BACKGROUND OF THE INVENTION

1. Field Of The Invention

There is a distinct need throughout the industry for an effective cooling device for garments worn by workers in industrial applications where heat stress can be a problem. With such designs it is important that the final configuration of the cooling garment be simple and have low operational costs and minimal environmental impact as well as being significantly comfortable for the user to wear.

Prior systems utilizing the vortex valving configurations are well known. However, the amount of gas consumed by such systems is extremely high as compared to the gas or air consumption of the present design. Other systems utilize "water circulation systems" or "ice pack" retaining systems which provide external cooling to the body. These systems are extremely expensive and have limited life due to the fact that it requires external cooling. The best systems are those utilizing the normal evaporative characteristics of human skin and perspiration. The present invention provides a means for achieving this cooling in this natural way and yet greatly minimizes the consumption of gas volume necessary to achieve this cooling.

2. Description Of The Prior Art

Prior art devices have been utilized for gas ventilated garments with various valving configurations such as those shown in J. Bears U.S. Pat. No. 2,712,399 patented on Jul. 5, 1955 and assigned to Metropolitan-Vickers Electrical Company Limited on an Apparatus For Obtaining Desired Quantities Of A Gas; T. Iketani U.S. Pat. No. 3,083,554 patented Apr. 2, 1963 on a Mechanism For Flow Control Of Gaseous Fuel In A Cigarette Lighter; E. Cherowbrier et al U.S. Pat. No. 3,113,320 patented Dec. 10, 1963 on a Ventilated Coverall-Type Garment; T. Iketani U.S. Pat. No. 3,161,033 patented Dec. 15, 1964 on Fluid Flow Control Devices For Liquefied Gas Lighters; P. Webb U.S. Pat. No. 3,174,300 patented Mar. 23, 1965 on Personnel Isolation And Protection Systems; D. C. Jennings U.S. Pat. No. 3,289,748 patented Dec. 6, 1966 and assigned to United Aircraft Corporation on a Heat Transfer Garment; D. C. Jennings U.S. Pat. No. 3,345,641 patented Oct. 10, 1967 and assigned to United Aircraft Corporation on a Ventilated Space Suit; L. L. Copeland U.S. Pat. No. 3,348,236 patented Oct. 24, 1967 on a Fluid Ventilated Suit; G. S. MacLoed et al U.S. Pat. No. 3,496,703 patented Feb. 24, 1970 and assigned to Rite Hardware Manufacturing Co. on a Backpack Air-Conditioning Apparatus; W. J. O'Neill et al U.S. Pat. No. 3,568,209 patented Mar. 9, 1971 and assigned to Westinghouse Electric Corporation on a Protective Suit Apparatus; K. Mayo et al U.S. Pat. No. 3,675,244 patented Jul. 11, 1972 and assigned to Sanders Nuclear Corp. on Self-Compensating Thermal Insulation Garments; L. A. Spano et al U.S. Pat. No. 3,710,395 patented Jan. 16, 1973 and assigned to The United States of America as represented by the Secretary of the Army on an Air Distribution Garment; K. Myers U.S. Pat. No. 3,761,962 patented Oct. 2, 1973 on a Ventilated Suit; E. Hartigan U.S. Pat. No. 3,790,964 patented Feb. 12, 1974 and assigned to The Kendall Company on a Vented Operating Room Gown; N. Charns et al U.S. Pat. No. 3,829,124 patented Aug. 13, 1974 and assigned to General Motors Corporation on a Bleed Cap For A Vehicle Air Cushion Inflator; H. Stetson U.S. Pat. No. 3,942,684 patented Mar. 9, 1976 and assigned to Martin Engineering Co. on an Air Accumulator And Aerator For Materials-Handling; B. Doin et al U.S. Pat. No. 3,986,456 patented Oct. 19, 1976 and assigned to Societe Nationale des Poudres et Explosifs on a Pyrotechnic Gas Generator Having A Movable Combustion Chamber; B. Jenkins et al U.S. Pat. No. 4,146,933 patented Apr. 3, 1979 and assigned to Barry R. Jenkins on a Conditioned-Air Suit And System; H. Markve U.S. Pat. No. 4,185,327 patented Jan. 29, 1980 on a Ventilating And Insulating Garment; C. Melander U.S. Pat. No. 4,194,247 patented Mar. 25, 1980 and assigned to East Wind Industries, Inc. on a Wearable Ventilation System; H. Fujiyama et al U.S. Pat. No. 4,246,672 patented Jan. 27, 1981 and assigned to Nippon Oil And Fats Company and Fujikura Rubber Works on an Automatic Inflatable Safety Work Vest; E. Warncke U.S. Pat. No. 4,403,608 patented Sep. 13, 1983 and assigned to Dragerwerk Aktiengesellschaft on a Pressure Gas Ventilated Protective Suit And Method Of Operating The Suit; R. Rankin, Sr. et al U.S. Pat. No. 4,513,452 patented Apr. 30, 1985 on a Heat Resistant Suit For Use In Boiler Repair; M. Piet U.S. Pat. No. 4,619,285 patented Oct. 28, 1986 and assigned to Futurecraft Corporation on a Fluid Flow Control Device; H. Lockwood, Jr. U.S. Pat. No. 4,911,403 patented Mar. 27, 1990 and assigned to NEA Technologies on a Pressure Responsive Two-Way Shut-Off Valve; T. Hinson et al U.S. Pat. No. 4,914,752 patented Apr. 10, 1990 and assigned to Abandaco, Inc. on a Temperature-Regulated Garment Utilizing A Vortex Tube; T. Nitta U.S. Pat. No. 4,929,176 patented May 29, 1990 and assigned to Tokai Corporation on a Noncontrolling Type Valve; W. Blackburn et al U.S. Pat. No. 5,005,216 patented Apr. 9, 1991 and assigned to Abandaco, Inc. on a Self-Ventilating Protective Garment; G. Want U.S. Pat. No. 5,070,858 patented Dec. 10, 1991 on a Gas Container Connecting Device For Portable Gas Stove and M. Napolitano U.S. Pat. No. 5,088,115 patented Feb. 18, 1992 and assigned to E. D. Bullard Company on a Ventilated Full Body Protective Garment.

SUMMARY OF THE INVENTION

The present invention provides an improved design for a gas ventilated garment to be worn by a user which has an extremely low gas consumption rate resulting from a unique radial valving configuration. The design of the present invention includes a garment such as a jacket preferably formed of a nylon fabric material which is adapted to be worn by a user. This jacket design can include a separate cap member for facilitating cooling of the head of the user.

A primary manifold is included which is attached to the jacket and defines a plenum chamber therein adapted to receive ventilation gas therein for facilitating distribution thereof. This primary manifold defines an inlet aperture in fluid flow communication with respect to a plenum chamber and is adapted to receive ventilation gas therethrough. The primary manifold also includes a plurality of outlet apertures preferably about the periphery thereof which are in fluid flow communication with respect to the plenum chamber to facilitate distribution of ventilation gas therefrom.

A primary gas inlet nozzle is preferably positioned within the inlet aperture of the primary manifold to facilitate the control of flow of ventilated gas therein. A primary air line preferably extends from this primary gas inlet nozzle to a source of pressurized gas or air which can be supplied at a pressure of from 20 to 125 pounds per square inch. A plurality of gas conduits are positioned in fluid flow communication with respect to each of the outlet apertures of the primary manifold to facilitate the distribution of ventilation gas therefrom.

A plurality of ventilation gas radial dispersion valves are attached at various locations throughout the jacket or garment with each being adapted to release ventilation gas radially in a circular pattern into an area between the jacket and the user. In this manner cooling of the user will be greatly facilitated especially when the user wears an undergarment of wicking material to retain the moist perspiration of the user adjacent the user's skin. Each of these radial gas dispersion valves are preferably connected to one of the gas conduits to receive ventilation gas therethrough from the primary manifold.

These radial dispersion valves normally include six positions within a jacket and a seventh within a separate cap member if included in the chosen design. Each of the individual ventilation gas dispersion valves includes a valve body having a valve chamber therein adapted to receive ventilation gas for facilitating radial dispersion therefrom. The valve body is preferably annular and defines a valve inlet aperture which is in fluid flow communication with respect to the valve chamber means to facilitate entry of ventilation gas. The valve inlet aperture means is preferably in fluid flow communication with at least one of the gas conduits in such a manner as to provide the means for receiving ventilation gas therefrom. The valve body also includes a valve outlet aperture in fluid flow communication with respect to the annular valve chamber in such a manner as to facilitate distribution of the dispersed ventilation gas therefrom in a radial fashion. The valve body further defines a securement bore extending therethrough.

A valve release control member is movably secured with respect to the valve body and is positioned extending over the valve outlet aperture as desired in order to restrict the volume of ventilation gas released radially through each of the ventilation gas radial dispersion valves to approximately 0.66 cubic feet per minute. This very slow rate of release will achieve full cooling for the user and yet will greatly restrict energy consumption by minimizing total volume of gas flow through the system. The valve release control preferably includes a securement stud pressed within the securement bore of the valve body to facilitate positioning of the valve release control with respect to the valve body and to control the release of ventilated gas thereby. This securement stud also preferably defines a threaded central bore extending therethrough.

A plurality of threaded mounting studs are each adapted to extend through a jacket at various locations after passing through a mounting washer to be secured into one of the threaded central bores of the securement studs of one of the central gas radial dispersion valves positioned thereadjacent for securement thereof with respect to the garment. In this manner the individual radial dispersion valve will be fixedly positioned at various locations throughout the garment or jacket area. These areas are chosen strategically in order to achieve accurate cooling such as adjacent the underarms, in the chest area, in the kidney area and if the additional cap means is included, adjacent the head area thereof It is object of the present invention to provide an improved gas ventilated garment to be worn by a user and having a low gas consumption valving configuration wherein maintenance costs are minimized.

It is object of the present invention to provide an improved gas ventilated garment to be worn by a user and having a low gas consumption valving configuration wherein system down time is minimized.

It is object of the present invention to provide an improved gas ventilated garment to be worn by a user and having a low gas consumption valving configuration wherein initial cost is minimized.

It is object of the present invention to provide an improved gas ventilated garment to be worn by a user and having a low gas consumption valving configuration wherein conventional pressurized air sources of from 20 to 125 pounds per square inch can be utilized.

It is object of the present invention to provide an improved gas ventilated garment to be worn by a user and having a low gas consumption valving configuration wherein the total rate of consumption of ventilation gas is less than five cubic feet per minute.

It is object of the present invention to provide an improved gas ventilated garment to be worn by a user and having a low gas consumption valving configuration wherein individual gas dispersion valves are positioned at strategic locations throughout the ventilation garment and release ventilation gas in a radial pattern therearound.

It is object of the present invention to provide an improved gas ventilated garment to be worn by a user and having a low gas consumption valving configuration wherein individual radial dispersion valves are each restricted to leasing less than one cubic feet per minute of ventilation gas while still achieving full cooling of the user.

It is object of the present invention to provide an improved gas ventilated garment to be worn by a user and having a low gas consumption valving configuration wherein additional cooling of the head area of the user can be achieved.

It is object of the present invention to provide an improved gas ventilated garment to be worn by a user and having a low gas consumption valving configuration wherein full cooling can be achieved in many of the most heat stress related industrial applications.

It is object of the present invention to provide an improved gas ventilated garment to be worn by a user and having a low gas consumption valving configuration wherein a uniform low volume mist of cool air is achieved to promote the evaporative body cooling.

It is object of the present invention to provide an improved gas ventilated garment to be worn by a user and having a low gas consumption valving configuration wherein cooling is achieved by evaporative body cooling as well as expansion of air being dispersed radially from the individual release valves.

It is object of the present invention to provide an improved gas ventilated garment to be worn by a user and having a low gas consumption valving configuration wherein the cooling garment can be worn for extended periods of time and does not require periodically or hourly replenishment of any sort.

It is object of the present invention to provide an improved gas ventilated garment to be worn by a user and having a low gas consumption valving configuration wherein usefulness in extremely humid environments is made possible.

It is object of the present invention to provide an improved gas ventilated garment to be worn by a user and having a low gas consumption valving configuration wherein use with a portable supply of pressurized air can provide complete portability.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a front perspective illustration of an embodiment of the improved gas ventilated garment having a low gas consumption valving configuration of the present invention shown being worn by a user;

FIG. 2 is a rear plan view of the embodiment shown in FIG. 1;

FIG. 3 is a side cross-sectional view of an embodiment of a ventilation gas radial dispersion valve of the present invention;

DESCRIPTION OF THE PREFERRED EMBODIMENT

Figure 4:
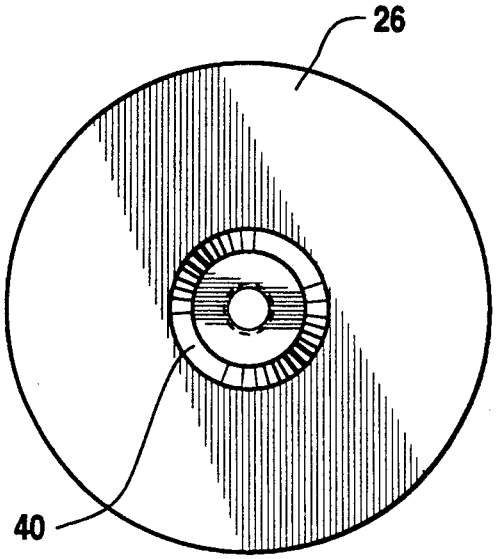
FIG. 4 is a bottom plan view of a valve release control member of the present invention.
Figure 5:
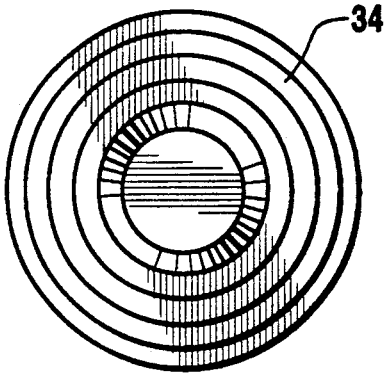
FIG. 5 is a top plan view of the embodiment shown in FIG. 4.

The present invention provides an improved means for ventilating of a user wearing a garment by the application of gas such as air at low flow rates immediately adjacent to the user's body. The garment 10 will normally comprise the general configuration of a jacket and may include a cap 60 for facilitating ventilating of the head of a user 12.

The configuration of the ventilation system includes a primary manifold 14 secured at an easily accessible or central location upon the garment 10 to facilitate attachment of a primary air line 52 secured thereto. Primary air line 52 is adapted to be secured with respect to a source of pressurized gas normally being pressurized air supplied at between 20 and 125 pounds per square inch. To facilitate securement of the primary air line 52 with respect to the primary manifold 14 a primary gas inlet nozzle 50 may be positioned within the inlet aperture 18 defined in the primary manifold 14.

The primary manifold preferably defines a plenum chamber 16 therein which includes an inlet aperture 18 and an outlet aperture 20 defined therein to facilitate the entry and exhausting of ventilation gas from plenum chamber 16. The outlet aperture means 20 will include a plurality of individual outlet apertures each being connected with respect to a gas conduit means 22 which each may comprise a plastic or other flexible distribution line. These gas conduit means are adapted to carry the ventilation gas throughout the garment 18 to the various positions of the ventilation gas radial dispersion valve 24.

Radial dispersion valve 24 will preferably be secured at specific locations within the garment 10 in order to facilitate cooling of the user 12. In particular, such locations would include positioning of the radial dispersion valves in the underarm area, in the chest area, in the back area and also in the head area when the cap member 60 is included within the configuration of the garment 10. It has been found that the positioning of the radial dispersion valves 24 in these specific locations will most effectively create a cooling of the user 12 by way of normal evaporative body cooling and air expansion.

The individual radial dispersion valves 24 each include a valve body 26 which defines a valve chamber 28 therein which is preferably of an annular shape. The annular valve chamber 28 is adapted to receive ventilation gas through the gas conduit means 22. For this purpose the valve body 26 will further define a valve inlet aperture 30 for allowing air to enter into the valve chamber 28. The valve body 26 will further define a valve outlet aperture 32 to facilitate the radial release of ventilation gas from the valve chamber. As such, pressurized gas will enter through the valve inlet apertures 30 into the valve chamber means 28 and then can be selectively released through valve outlet apertures 32 to cool the surrounding environment by radial flow of ventilation gas.

A valve release control 34 will preferably extend over the valve outlet 32 to restrict the volume of air exiting through the valve outlet 32 for cooling and to orient the released pattern of air or gas into a generally circular or radial release pattern. The radial release of the ventilation gas is shown best by arrows 36 on FIGS. 1 and 2 which show the radial release pattern from individual locations of the radial dispersion valve 24.

To facilitate positioning of the valve release control 34 with respect to the valve body 26, the valve body 26 will preferably define a securement bore 38 extending axially therethrough preferably through the middle of the annular valve chamber 28. There should be no fluid flow communication between the securement bore 38 and the annular valve chamber 28. A mated securement stud 40 will preferably be defined on the valve release control 34 and be adapted to be pressed into engagement in the securement bore 38. The press fit between the securement stud 40 and the securement bore 38 will allow control of positioning of these parts with respect to one another thereby controlling the amount of air passing outwardly through the valve outlet aperture 32. Also, the positioning of the securement stud 40 in a central location extending through the center of the annulus of the valve chamber 28 will cause the ventilation gas to be expelled therefrom in a slow radial fashion as shown by the arrows 36 in FIGS. 1 and 2.

Figure 11:
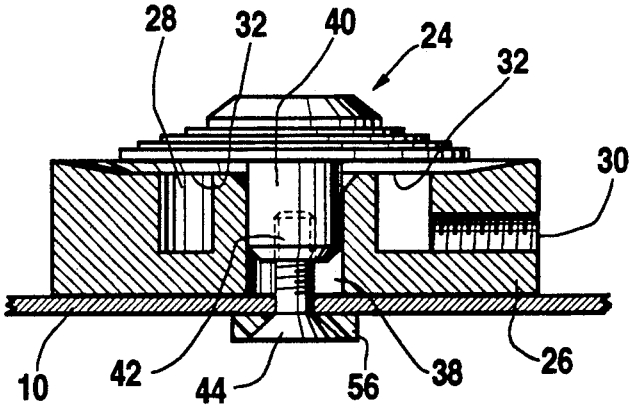
FIG. 11 is a side plan cross-sectional view of an embodiment of a ventilation gas radial dispersion valve shown fixed in position with respect to a garment.
Figure 6:
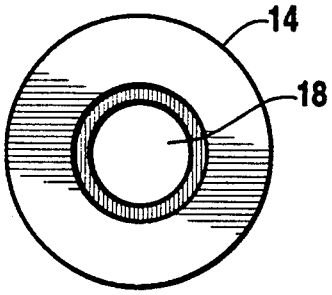
FIG. 6 is a top plan view of an embodiment of the primary manifold of the present invention.
Figure 7:
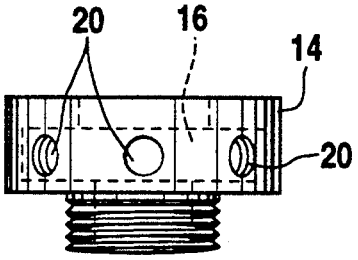
FIG. 7 is a side cross-sectional view of the embodiment shown in FIG. 6.
Figure 9:
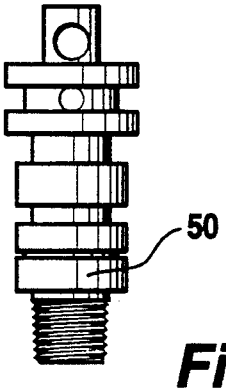
FIG. 9 is a side plan view of an embodiment of the primary gas inlet nozzle of the present invention.
Figure 8:
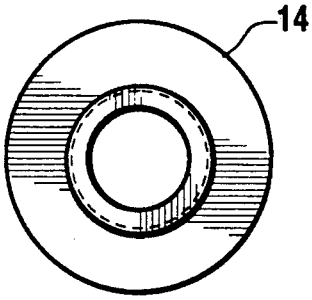
FIG. 8 is a bottom plan view of the embodiment shown in FIG. 6.
Figure 10:
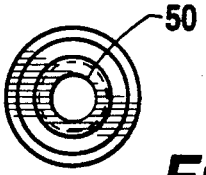
FIG. 10 is a bottom plan view of the embodiment shown in FIG. 9.

It is preferable to provide a means for securement of the individual radial dispersion valves 24 with respect to the garment 10. This securement can be achieved by the inclusion of a central bore 42 positioned axially within the individual securement stud 40 of each valve release control means 34. This central bore 42 is preferably female threaded and is adapted to engage a male threaded mounting stud 44. In the normal configuration of the present invention as shown in FIG. 11, mounting stud 44 will extend through a mounting washer 56 and then through the material of the garment 10 which may be a nylon or other fabric material and into threaded engagement with respect to the central bore 42 defined within the securement bore 38. Furthermore, positioning of the valve release control member 34 with respect to the securement bore 38 can be achieved by control of rotation of the mounting stud 44. In this manner external modification of the ventilation gas release characteristics of the radial dispersion valves 24 can be achieved.

In the preferred configuration of the present invention the garment 10 is of a jacket shape and defines therein a jacket chamber 54. Preferably this jacket chamber includes elastic members 62 at the neck and wrists and can also include a drawstring 58 at the waist of a user. In this manner an air chamber will be defined adjacent to the body of a user 12 for retaining of the ventilation gas released through the multiple individual radial dispersion valves 24. This air will accumulate over time.

In the preferred configuration of the present invention the user will wear a "wicking" garment such as a cotton T-shirt under the garment 10. This wicking garment will tend to gather and hold the moisture from the perspiration of the user 12 immediately adjacent the skin of this user. In this manner the cooling resulting from ventilation gas being radiated in a circular manner from the dispersion valves 24 will achieve effective cooling of the user's skin which is in direct contact with the wicking undergarment.

In operation the ventilation gas can be supplied at a permanent station or by a mobile means such as a pressurized air canister which can be attached with respect to the user 12 or with respect to the garment 10. The use of a portable self-contained canister will provide more portability to the design of the present invention.

With either the stationary or portable configuration the air source will provide pressurized air at between 20 and 125 pounds per square inch to the primary air line 52. This air line will carry the ventilation gas to the primary gas inlet nozzle 50 which will facilitate passage of this gas through the inlet aperture 18 and into the plenum chamber 16 of the primary manifold 14. This ventilation as will then pass outwardly through the multiple outlet apertures 20 of the primary manifold 14 and through the multiple gas conduits 22 to the individual valve inlet apertures 30 of each radial dispersion valve 24. The ventilation as will then be accumulated within the valve chamber means 28 of each radial dispersion valve 24 and will be available for radial release outwardly through the valve outlet apertures 32 while passing the valve release control 34. The amount of pressurized gas released will be controlled by positioning of the valve release control 34 with respect to the valve body 26 and in particular by positioning of the securement stud 40 with respect to the securement bore 38. The choice of strategic positioning throughout the jacket garment 10 of the individual radial dispersion valves 24 will achieve effective cooling for the user.

The inclusion of the cap member 60 with an individual radial dispersion valve 24 positioned therein will provide an additional element of cooling which can be very important under certain circumstances. It is well known that cooling of the head area of the user 12 is of primary importance in achieving cooling of the entire body of a user 12. As such, the inclusion of the cap unit 60 in the overall configuration of the present invention although it provides the requirement of the use of an additional or seventh radial dispersion valve 24 is very effective in achieving overall cooling. The normal configuration for the jacket garment 10 will include six radial dispersion valves 24 positioned in spaced relation with respect to one another.

A primary advantage of the present invention is in the conservation of pressurized ventilation gas. The present invention is extremely economical to use since it usually operates at approximately 3 to 4 cubic feet per minute of relatively dry air which can be supplied at the normal range of pressurized gas or air which is between 20 and 125 pounds per square inch. Prior art devices normally operate at 15 to 50 cubic feet per minute which can be extremely expensive to use for extended periods of time or for a large number of users.

The positioning of the six radial flows are placed to contact critical hot zones in the normal body of a user 12. These areas are the chest, the kidneys and the underarms. The head cooling is particularly adaptable by the inclusion of the one-size fits all cooling cap 60 which can achieve cooling by the positioning of a single radial dispersion valve 24 therein.

Due to the extremely low volume of air passing through the garment 10 of the present invention the user 12 can barely notice any gas release. This additional aspect of the configuration of this protected garment being "user friendly" will greatly enhance the comfort and ease of use and as such will greatly increase the propensity of a worker to actually make use of the ventilated garment of the present invention. Many previous designs were extremely complicated or heavy or consumed large amounts of ventilating gas or were very difficult to put on. The present invention provides a configuration which solves all these problems and at the same time greatly minimizes the usage of ventilation gas.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An improved gas ventilated garment to be worn by a user and having a low gas consumption valving configuration comprising;

A. a garment means of material adapted to be worn by a user;

B. a primary manifold means attached to said garment means and defining a plenum chamber means therein adapted to receive ventilation gas therein, said primary manifold means defining an inlet aperture means therein in flow communication with respect to said plenum chamber means and adapted to receive ventilation gas therethrough, said primary manifold means further defining a plurality of outlet aperture means therein in fluid flow communication with respect to said plenum chamber means to facilitate distribution of ventilation gas therefrom;

C. a plurality of gas conduit means positioned in fluid flow communication with respect to at least one of said outlet aperture means of said primary manifold means to receive ventilation gas therefrom;

D. a plurality of ventilation gas radial dispersion valves attached at multiple locations to said garment means with each being adapted to release ventilation gas radially in an area between said garment means and a user to facilitate cooling of a user, each of said ventilation gas radial dispersion valves comprising:

(1) a valve body defining a valve chamber means therein to receive ventilation gas therein for facilitating dispersion thereof radially, said valve body further defining a valve inlet aperture means being in fluid flow communication with respect to said valve chamber means to facilitate entry of ventilation gas therein, said valve inlet aperture means being in fluid flow communication with respect to at least one of said gas conduit means to receive ventilation gas therefrom, said valve body further defining a valve outlet aperture means in fluid flow communication with respect to said valve chamber means for facilitating distribution of dispersed ventilation gas therefrom; and (2) a valve release control means movably secured to said valve body and positioned extending over said valve outlet aperture means to restrict the volume of ventilation gas released radially through each of said ventilation gas radial dispersion valve to less than one cubic foot per minute.

2. An improved gas ventilated garment to be worn by a user and having a low gas consumption valving configuration as defined in claim 1 wherein said garment means is made of fabric material.

3. An improved gas ventilated garment to be worn by a user and having a low gas consumption valving configuration as defined in claim 1 wherein said garment means is made of a woven fabric material.

4. An improved gas ventilated garment to be worn by a user and having a low gas consumption valving configuration as defined in claim 1 wherein said garment means is made of a nylon fabric material.

5. An improved gas ventilated garment to be worn by a user and having a low gas consumption valving configuration as defined in claim 1 wherein said valve chamber means is annular in shape.

6. An improved gas ventilated garment to be worn by a user and having a low gas consumption valving configuration as defined in claim 1 wherein said ventilation gas radial dispersion valves are adapted to distribute ventilation gas radially into a circular pattern therearound.

7. An improved gas ventilated garment to be worn by a user and having a low gas consumption valving configuration as defined in claim 1 wherein each of said valve body defines a securement bore extending therethrough and wherein each said valve release control means includes a securement stud adapted to extend into one of said securement bores to be selectively secured therein.

8. An improved gas ventilated garment to be worn by a user and having a low gas consumption valving configuration as defined in claim 7 wherein said securement stud is pressed in place within said securement bore.

9. An improved gas ventilated garment to be worn by a user and having a low gas consumption valving configuration as defined in claim 7 further including a plurality of mounting studs and wherein each of said securement stud defines a central bore therein adapted to receive one of said mounting studs therein to facilitate mounting of said ventilation gas radial dispersion valves with respect to said garment means.

10. An improved gas ventilated garment to be worn by a user and having a low gas consumption valving configuration as defined in claim 9 wherein said central bore and said mounting stud are both threaded to facilitate mutual engagement therebetween.

11. An improved gas ventilated garment to be worn by a user and having a low gas consumption valving configuration as defined in claim 7 wherein said securement stud is positionable within said securement bore at selective locations to modify the amount of ventilation air release radially by each of said valve release control means.

12. An improved gas ventilated garment to be worn by a user and having a low gas consumption valving configuration as defined in claim 11 wherein said securement stud if positioned within said securement bore to restrict release of ventilation air radially to approximately 0.66 cubic foot per minute for each of said ventilation gas radial dispersion valve means.

13. An improved gas ventilated garment to be worn by a user and having a low gas consumption valving configuration as defined in claim 1 wherein said gas conduit means comprise plastic distribution lines.

14. An improved gas ventilated garment to be worn by a user and having a low gas consumption valving configuration as defined in claim 1 further comprising a primary gas inlet nozzle positioned within said inlet aperture means of said primary manifold means to facilitate flow of ventilation gas therein.

15. An improved gas ventilated garment to be worn by a user and having a low gas consumption valving configuration as defined in claim 1 wherein said inlet aperture means of said primary manifold means is in fluid flow communication with respect to a source of air supplied at between 20 and 125 pounds per square inch.

16. An improved gas ventilated garment to be worn by a user and having a low gas consumption valving configuration as defined in claim 15 further comprising a primary air line extending from said inlet aperture means of said primary manifold means to a source of pressurized air.

17. An improved gas ventilated garment to be worn by a user and having a low gas consumption valving configuration as defined in claim 1 including less than seven of said ventilation gas radial dispersion valves secured in spaced relation with respect to one another within said garment means.

18. An improved gas ventilated garment to be worn by a user and having a low gas consumption valving configuration as defined in claim 17 wherein said garment means includes a jacket means.

19. An improved gas ventilated garment to be worn by a user and having a low gas consumption valving configuration as defined in claim 18 wherein at least one of said ventilation gas radial dispersion valves is positioned adjacent an arm area of said jacket means.

20. An improved gas ventilated garment to be worn by a user and having a low gas consumption valving configuration as defined in claim 18 wherein at least one of said ventilation gas radial dispersion valves is positioned adjacent a back area of said jacket means.

21. An improved gas ventilated garment to be worn by a user and having a low gas consumption valving configuration as defined in claim 18 wherein at least one of said ventilation gas radial dispersion valves is positioned adjacent a frontal area of said jacket means.

22. An improved gas ventilated garment to be worn by a user and having a low gas consumption valving configuration as defined in claim 18 wherein at least one of said ventilation gas radial dispersion valves is positioned adjacent a kidney area of said jacket means.

23. An improved gas ventilated garment to be worn by a user and having a low gas consumption valving configuration as defined in claim 18 further comprising a cap member positionable extending over a head area of a user and wherein at least one of said ventilation gas radial dispersion valves is positioned within said cap member to facilitate cooling of a user's head.

24. An improved gas ventilated garment to be worn by a user and having a low gas consumption valving configuration as defined in claim 17 wherein the total gas flow through all of said ventilation gas radial dispersion valves is less than five cubic feet per minute.

25. An improved gas ventilated garment to be worn by a user and having a low gas consumption valving configuration as defined in claim 18 wherein said jacket means defines a jacket chamber therein for receiving and retaining gas received from said ventilation gas radial dispersion valves in position adjacent the body of a user to facilitate cooling thereof.

26. An improved gas ventilated garment to be worn by a user and having a low gas consumption valving configuration comprising;

A. a jacket means of nylon fabric material adapted to be worn by a user, said jacket means including a cap member;

B. a primary manifold means attached to said jacket means and defining a plenum chamber means therein adapted to receive ventilation gas therein, said primary manifold means defining an inlet aperture means therein in flow communication with respect to said plenum chamber means and adapted to receive ventilation gas therethrough, said primary manifold means further defining a plurality of outlet aperture means therein in fluid flow communication with respect to said plenum chamber means to facilitate distribution of ventilation gas therefrom;

C. a primary gas inlet nozzle positioned within said inlet aperture means of said primary manifold means to facilitate flow of ventilation gas therein;

D. a primary air line extending from said primary gas inlet nozzle to a source of pressurized air supplied at 20 to 125 pounds per square inch;

E. a plurality of gas conduit means positioned in fluid flow communication with respect at least one of said outlet aperture means of said primary manifold means to receive ventilation gas therefrom;

F. a plurality of ventilation gas radial dispersion valves attached at multiple locations to said jacket means with each being adapted to release ventilation gas radially in a circular pattern in an area between said jacket means and a user to facilitate cooling of a user, said ventilation gas radial dispersion valves being less than seven in number, each of said ventilation gas radial dispersion valves comprising:

(1) a valve body defining a valve chamber means therein to receive ventilation gas therein for facilitating dispersion thereof radially, said valve body being annular and defining a valve inlet aperture means being in fluid flow communication with respect to said valve chamber means to facilitate entry of ventilation gas therein, said valve inlet aperture means being in fluid flow communication with respect to at least one of said gas conduit means to receive ventilation gas therefrom, said valve body further defining a valve outlet aperture means in fluid flow communication with respect to said valve chamber means for facilitating distribution of dispersed ventilation gas therefrom, said valve body further defining a securement bore extending therethrough;

(2) a valve release control means movably secured to said valve body and positioned extending over said valve outlet aperture means to restrict the volume of ventilation gas released radially through each of said ventilation gas radial dispersion valve to approximately 0.66 cubic foot per minute, said valve release control means including a securement stud pressed within said securement bore of said valve body to facilitate positioning of said valve release control means with respect to said valve body and control release of ventilation gas therefrom, said securement stud defining a threaded central bore therein; and G. a plurality of threaded mounting studs each adapted to extend through said jacket means at a different location into one of said threaded central bores of said securement studs of one of said ventilation gas radial dispersion valve positioned thereagainst for securement thereof with respect to said garment means.

* * * * *